United States Patent [19]

Umemura et al.

[11] Patent Number: 4,692,256

[45] Date of Patent: Sep. 8, 1987

[54] MOLYBDENUM-CONTAINING LUBRICANT COMPOSITION

[75] Inventors: Masashi Umemura; Masanori Konishi; Aritoshi Fukushima; Junichi Hisano; Toshiaki Okamoto, all of Tokyo, Japan

[73] Assignee: Asahi Denka Kogyo K.K., Tokyo, Japan

[21] Appl. No.: 871,647

[22] Filed: Jun. 6, 1986

[30] Foreign Application Priority Data

Jun. 12, 1985 [JP] Japan ..... 60-127309
Jun. 12, 1985 [JP] Japan ..... 60-127310

[51] Int. Cl.[4] ..... C10M 137/10

[52] U.S. Cl. ..... 252/32.7 E; 252/46.4; 252/47.5; 252/400.54; 252/389.54

[58] Field of Search ..... 252/32.7 E, 46.4, 47.5, 252/389.54, 400.54

[56] References Cited

U.S. PATENT DOCUMENTS 3,282,838 11/1966 Knowles et al. ..... 252/49.7
3,400,140 9/1968 Rowan et al. ..... 252/49.7
3,509,051 4/1970 Farmer et al. ..... 252/46.4
4,201,683 5/1980 Brewster ..... 252/49.7

FOREIGN PATENT DOCUMENTS 26870 12/1963 Japan ..... 252/49.7

*Primary Examiner*—Jacqueline V. Howard
*Attorney, Agent, or Firm*—Flynn, Thiel, Boutell & Tanis

[57] ABSTRACT

A lubricant composition comprises as essential ingredients a sulfur compound and an oil-soluble molybdenum compound, obtained by reacting one or more of hexavalent molybdenum compounds selected from the group consisting of molybdenum polyoxide, molybdic acid and the alkali salt thereof or a compound prepared by reaction of the compounds and a reducing agent, with an amino compound represented by the general formula:

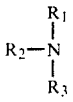

wherein $R_1$, $R_2$ and $R_3$ which may be identical with or different from each other individually represent hydrogen atoms or hydrocarbon groups of 1 to 30 carbon atom. The lubricant additives comprising the novel molybdenum-amine complex and the sulfur-containing compound in combination are excellent in the anti-oxidation, anti-wear and friction-reducing effect and, particularly, excellent in view of the metal corrosion.

11 Claims, No Drawings

MOLYBDENUM-CONTAINING LUBRICANT COMPOSITION

BACKGROUND OF THE INVENTION

1. Field of the Invention

This invention concerns a novel oil-soluble molybdenum compositions useful as a lubricant additive.

Particularly, this invention concerns a lubricant composition containing an oil-soluble molybdenum compound which is excellent in anti-oxidation effect, anti-wear effect, friction reducing effect and mineral oil solubility, as well as excellent in view of metal corrosion, particularly, for copper, iron, etc.

2. Description of the Prior Art

Various kinds of compositions have been known so far as lubricant additive for use in engine oils and the like, but the performance demanded for the lubricant additives has become more severe in recent years in view of the resource saving and energy saving. For the improvement in the wear resistance, zinc dithiophosphate (hereinafter referred as ZDTP) has heretofore been used generally and, in addition, molybdenum dithiophosphate (hereinafter referred to as Mo-DTP) has also been used as disclosed in Japanese Patent Publications Nos. 8426/1965 and 27366/1969 or Japanese Patent Laid-Open No. 110796/1981, etc.

However, both of ZDTP and Mo-DTP contain phosphorus atoms and, since the total amount of phosphorus that can be added is restricted, taking into consideration the phosphorus poisoning of automobile exhaust gas purifying catalysts that are used. As one of the countermeasures for the atmospheric pollution, there is a certain limit on the amounts of compounds tht can be used.

While on the other hand, a number of molybdenum dithiocarbamate compounds (hereinafter referred to as Mo-DTC) have also been reported (refer to Japanese Patent Publications Nos. 6362/1974, 964/1976, 31646/1978, 12638/1981, etc.). However, although these compounds are free from the problems in view of the catalyst poisoning, they involve a serious drawback that the lubricating performance is not satisfactory and the solubility of them in the base oils such as mineral oils is poor.

In addition, these known ZDTP, Mo-DTP and Mo-DTC compounds have various drawbacks respectively as described above and it is particularly mentioned that they have a common major drawback namely a significant corrosive nature to metals (refer to SAE Paper 851260).

It has been considered essential that organic molybdenum compounds useful as lubricant additives should contain sulfur atoms in the molecules of the compounds. That is, has been considered that the lubricating performance can be obtained by the formation of molybdenum disulfide on the lubricating surface by molybdenum and sulfur contained in the molecules. However, the present inventors have assumed that active sulfur atoms contained in the molecules may have undesirable effects in view of the metal corrosion and have made an earnest study in order to overcome the contraction. As a result, it has surprisingly been found that although the product obtained by the reaction between a molybdenum compound and an amino compound has no substantial performance when used alone as a lubricant additive, it exhibits extremely satisfactory lubricating performance when combined with a sulfur-containing compound.

SUMMARY OF THE INVENTION

Accordingly, it is an object of this invention to provide a lubricant composition having excellent lubricating performance and also satisfactory in view of metal corrosion.

The above object can be attained by a lubricant composition according to this invention containing, as essential ingredients, a novel oil-soluble molybdenum compound obtained by reacting one or more of hexavalent molybdenum compounds selected from the group consisting of molybdenum trioxide, molybdic acid or alkali salt thereof or a compound prepared by the reaction of said compounds and a reducing agent, with an amino compound represented by the general formula:

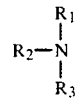

where $R_1$, $R_2$ and $R_3$, which may be identical with or different from each other individually represent hydrogen atom or hydrocarbon group of 1 to 30 carbon atoms and the total number of carbon atoms for $R_1$, $R_2$ and $R_3$ is 4 or greater, and a sulfur-containing compound.

The lubricant composition according to this invention has a lubricating performance comparable with or superior to that of ZDTP, Mo-DTP and Mo-DTC used so far and it is excellent in view of the metal corrosion.

DETAILED DESCRIPTION OF THE INVENTION

The hexavalent molybdenum compound usable herein can include molybdenum trioxide, molybdic acid and alkali salts thereof. It is desirable that the compound contains the alkali salt of molybdic acid to such an extent as can be uniformly dissolved entirely in water, particularly, in the case of using a reducing agent. The compound is not necessarily be dissolved completely but the reaction can proceed in the dispersed state. Sodium, potassium and ammonium salts can be exemplified as the alkali molybdate.

The reaction between the molybdic acid and the salt thereof with the reducing agent is carried out in water at a temperature from room temperature to 100° C. Reaction times of two hours at 50° C. or within one hour at 100° C. is sufficient, for example, in the case of using sodium hydrosulfite. In the case of using other reducing agents, the reaction time and the temperature should be selected depending on the reducing power of the reducing agents.

The reducing agent is used in an amount, preferably, from 1:0.5 to 1:5 and, more preferably, at 1:1 equivalent ratio based on the molybdic acid and the salt thereof.

All of those reducing agents capable of reducing the molybdenum valency from six to five or four can be used and they can include, for example, one or more of compounds selected from the group consisting of reducing sulfur compounds such as sodium sulfoxylate, sodium dithionite, sodium sulfite, sodium hydrogen sulfite, sodium pyrrosulfite, sodium thiosulfate, sodium dithionate or other alkali metal or alkaline earth metal salts thereof, hydrogen sulfide and sulfur dioxide; reducing saccharides such as glucose, maltose, lactose, maltotriose, manninotriose and the like; aldehydes such as formaldehyde, acetoaldehyde and propion aldehyde and reducing acids such as formic acid, oxalic acid, ascorbic acid and the salts thereof.

The reaction between the molybdenum compound and the amino compound is carried out at a temperature from the room temperature to 100° C. The reaction is carried out, although with no particular restriction, for about 0.5–3 hours and, usually, about for one hour.

The molybdenum atom-amine ratio is preferably from 1:1 to 1:4 and, particularly preferably at about 1:2. If the amine ratio is lesser, the oil solubility and the yield are worsened and, while on the other hand, if it is excessive, the amine is left unreacted.

In the case of initially using an alkali salt of molybdic acid, an acid corresponding to the amount of the alkali is used for neutralization at the last of the reaction and water is separated to obtain an oil-soluble or oil-dispersible molybdenum compound. Amino compounds usable herein can include, for example, linear primary amines such as n-butyl amine, n-octyl amine, lauryl amine and stearyl amine; branched primary amines such as isopropyl amine, isobutyl amine, 2-ethylhexyl amine and branched tridecyl amine; cycloaliphatic primary amines such as cyclohexyl amine and 2-methylcyclohexyl amine; aromatic-substituted primary amines such as benzyl amine and 4-methyl benzyl amine, linear secondary amines such as dimethylamine, diethylamine, di-n-propyl amine, di-n-butyl amine, di-n-octyl amine, dilauryl amine and distearyl amine; branched secondary amine such as diisopropylamine, diisobutylamine, di-2-ethylhexylamine and branched di-(tridecyl)amine; cycloaliphatic secondary amines such as dicyclohexyl amine and di-2-methylcyclohexyl amine; aromatic-substituted secondary amines such as dibenzyl amine and di-4-methyl benzyl amine; asymmetric secondary amines such as methyl n-butyl amine, ethyl lauryl amine, ethyl stearyl amine, isopropyl n-octyl amine, isobutyl 2-ethylhexyl amine, cyclohexyl 2-ethylhexyl amine, cyclohexyl benzyl amine, stearyl benzyl amine and 2-ethylhexyl benzyl amine; linear tertiary amines such as trimethyl amine, triethyl amine, tri-n-propyl amine, tri-n-butyl amine, tri-n-octyl amine, trilauryl amine and tristearyl amine; branched tertiary amine such as triisopropyl amine, triisobutyl amine, tri-2-ethylhexyl amine and branched tri-(tridecyl) amine; cycloaliphatic tertiary amines such as tricyclohexyl amine; aromatic-substituted tertiary amines such as tribenzyl amine and tri-4-methylbenzyl amine; and tertiary amines having mixed hydrocarbon groups such as dimethyl octyl amine, dimethyl lauryl amine, dimethyl stearyl amine, diethyl lauryl amine, dimethyl benzyl amine and dimethyl cyclohexyl amine or the mixtures thereof.

Among the amines, particularly preferred in view of the oil-solubility of the product are those secondary amine having hydrocarbon groups of 6–24 carbon atoms. If the carbon chain is shorter than the above, oil solubility is worsened and the type of base oils used as the lubricant oil is restricted. While on the other hand, if the carbon chain is longer than the above, effective concentration of molybdenum contained in the products is lowered.

Generally, primary amines are poor in the oil solubility, while tertiary amines give lower product yield.

Any of acids can be used as the neutralizing agent but mineral acid such as hydrochloric acid or sulfuric acid is more preferred in view of the cost and the separability of the aqueous layer after the reaction.

As the sulfur containing compounds as the other of the essential ingredients in this invention, a variety sulfur-containing compounds can be used. Since the molybdenum compound in this invention contains no phosphorus, phosphorus-containing compounds may also be used. Further, in the case of using a compound containing molybdenum and sulfur, a less corrosive composition to metals containing the same total molybdenum amount as usual can be obtained. The sulfur-containing compounds can include, for example, sulfurized fatty acids, sulfurized oils and fats, sulfurized olefins, disulfide compound such as dibenzyl sulfide, dithiocarbamate such as butylphenyl thiocarbamate disulfide, phosphorus and sulfur containing compounds such as tetraalkylthioperoxy phosphate, molybdemnum dithiocarbamate, molybdenum dithiophosphate and zinc dithiophosphate.

Among them, in the case of using a compound represented by the general formula;

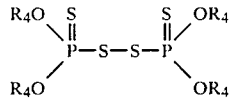

where the respective $R_4$, which may be identical with or different from each other represent hydrocarbon groups of 3 to 24 carbon atoms, a composition particularly excellent in the reduction of the frictional coefficient and antiwear effect can be obtained. Further, in the case of using a compound represented by the general formula:

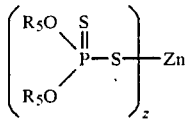

where respective $R_5$, which may be identical with or different from each other, represent hydrocarbon groups of 3 to 24 carbon atoms, and a compound represented by the general formula:

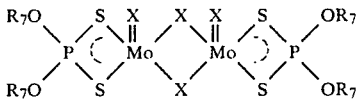

where respective $R_7$, which may be identical with or different from each other, represent hydrocarbon groups of 3 to 24 carbon atoms and X represents S or O, a composition particularly excellent in the reduction of the friction coefficient and the anti-wear effect can also be obtained.

Furthermore, in the case of using a compound represented by the general formula:

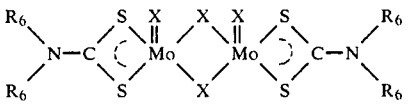

where respective $R_6$, which may be identical with or different from each other, represent hydrocarbon groups of 7 to 24 carbon atoms and X represents S or O, a composition excellent in the anti-wear effect although somewhat inferior in the reduction of the friction coefficient to the former three compounds can be obtained.

The ratio of the sulfur-containing compound to the molybdenum compound is more than 0.5 and, preferably, more than 1.5 of sulfur atoms per one molybdenum atom. There is no particular upper limit and the sulfur-containing compound may be added in a greater amount as the additives for the lubricant depending on the case. However, the upper limit for the molybdenum-sulfur ratio is usually of about 50.

The compound according to this invention is useful as a lubricant additive. Lubricants usually comprise base oils or base agents and various kinds of additives added depending on the application uses, etc. The compound according to this invention can properly be used in combination with these base oils, base agents and additives.

The base oils or base agents can include those of natural origin such as animal oils, vegetable oils, as well as oils and paraffins naphthene series or the mixture thereof obtained from petroleum.

The synthetic lubricant oils can include those hydrocarbon oils and halogen-substituted hydrocarbon oils such as olefin polymers and copolymers (for example, polybutylene, polypropylene, propylene-isobutylene copolymer, chlorinated polybutylene, poly(1-hexene), poly(1-octene), poly(1-decene), etc. as well as mixtures thereof), alkylbenzene (for example, dodecylbenzene, tetradodecylbenzene, dinonylbenzene, di(2-ethylhexyl)-benzene, etc.), polyphenyls (for example, biphenyl, terphenyl and alkyl polyphenyls), alkyldiphenyl ethers and alkyl diphenyl sulfide, as well as derivatives, homologs and analogs thereof. They further include those oils obtained by the polymerization of ethylene oxide or propylene oxide, alkyl and aryl ethers of these polyoxy alkylene polymers, or mono or polyvalent carboxylic acid esters or diesters thereof. They further include those esters of dicarboxylic acids (for example, phthalic acid, succinic acid, alkyl succinic acid or alkenyl succinic acid, sebacic acid, adipic acid and linoleic acid dimers) with various alcohols. Further, useful esters include those esters prepared from polyvalent alcohol ethers such as neopentyl glycol, trimethylol propane, pentaerythritol, dipentaerythritol and tripentaerythritol. Further, they can also include silicic acid type oils such as polyalkyl-, polyaryl-, polyalkoxy- or polyaryloxysiloxane oils and silicic acid salt oils, as well as liquid esters of phosphorus containing acids (TCP, TOP) diethyl ester of decylsulfonic acid.

Various kinds of additives may be added depending on the application uses and they can include, for example, ash-forming detergents or ashless dispersants, dispersants, corrosion and oxidation inhibitors, pour point depressant, extreme pressure agent, oil agent, pigment and defoamer.

The ash-forming detergents are typically represented by fat-soluble neutral or basic salts of alkali or alkaline earth metals with petroleum sulfonic acid, long-chained alkyl benzene sulfonic acid, alkylphenol, sulfurized alkylphenol, carboxylic acid or organic phosphoric acid at least containing one carbon-phosphorus direct coupling obtained by treating the olefin polymer with phosphorizing agent such as phosphor trichloride, phosphor pentasulfide and phosphor trichloride and sulfur. Those used most frequently are the salts of sodium, potassium, lithium, calcium, magnesium, strontium and barium. These cleaners as mentioned above further dispersed therein with excess metal hydroxides or carbonates may also be used.

The ashless dispersants can include carboxylic acid type dispersant, amine dispersant, Mannich dispersant, and copolymers of oil-soluble monomer such as decyl methacrylate, vinyl decyl ether and large molecular weight olefin with those monomers having polar substituent such as amino alkyl acrylate.

Typical examples of the oil agents, extreme pressure agents and corrosion and oxidation inhibitors are as follows:

(1) Chlorinated aliphatic hydrocarbons.

(2) Organic sulfides and polysulfides such as benzyl disulfide, bis(chlorobenzyl) disulfide, dibutyl tetrasulfide, methylester sulfide of olefinic acid, alkyl phenol sulfide, dipentene sulfide and terpene sulfide.

(3) Hydrocarbon phosphosulfides such as reaction product of phosphoric sulfide and turpentine and methyl olefinic carboxylate.

(4) Phosphorus esters mainly containing dihydrocarbon and trihydrocarbon hydrogen phosphite esters such as dibutyl, diheptyl, dicyclohexyl, pentylphenyl, dipentylphenyl, dioctyl, tridecyl, distearyl, dimethylnaphthyl and diisobutyl-substituted phenyl phosphites, phosphate esters such as tricresyl phosphate, trioctyl phosphate, tributyl phosphate, triphenyl phosphate and nonylphenyl phosphate.

(5) Metal salts of thiocarbamic acids such as zinc dioctyl carbamate, zinc diisoamyl dithiocarbamate, barium heptyl phenyl dithiocarbamate, antimony diisoamyl dithicocarbamate, oxymolybdenum ditridecyl dithiocarbamic sulfide oxymolybdenum di-2-ethylhexyl dithiocarbamic sulfide, and molybdenum dibutyl dithiocarbamic sulfide.

(6) Group II metal salts of phosphorodithionic acid such as zinc dicyclohexyl phosphorodithionate, zinc di-octylphosphorodithionate, barium-d-(heptylphenyl) phosphorodithionate, cadmium dinonyl phosphorodithionate and zinc salts of phosphorodithionic acid obtained by the reaction of phosphorus pentasulfide with an equi-molar mixture of isopropyl alcohol and n-hexyl alcohol, and oxymolybdenum sulfide salt of phosphorodithionic acid.

(7) Oil agent such as oleyl alcohol, stearyl alcohol, stearic acid, isostearic acid and oleic acid.

Among them, the compound containing sulfur can be used both as the sulfur-containing compound as one of the essential ingredients in this invention.

The application use of the lubricant using the compound according to this invention has no particular restrictions and the specific applications can include, for example, lubricants for use in the crank case of spark-ignition type and compression-ignition type internal combustion engines including automobile and track engines, 2-cycle engines, air craft piston engines and ship and locomotive diesel engines, lubricants for use in gas engines, fixed power engines and turbines, automatic transmission liquids, transaxle lubricants, gear lubricants, metal fabricating lubricants, hydraulic fluids and other lubricant or grease compositions.

This invention will be explained more specifically referring to examples and comparative examples.

EXAMPLE 1

One mol of sodium molybdate was dissolved in 540 ml of water under a nitrogen gas stream and then 2 mol of ditridecyl amine was dropped for one hour while keeping the temperature at 50°-60° C. and then further aged for one hour at that temperature. Then, one mol of aqueous 30% sulfuric acid solution was used for neutralization, the aqueous layer was separated to remove and the residue was dehydrated under a reduced pressure to obtain 820 g of pale blue oily product. The molybdenum content was 11.2% and the yield was 95.7% in view of molybdenum.

EXAMPLE 2

One mol of sodium molybdate was dissolved in 540 ml of water under a nitrogen gas stream and then one mol of di(2-ethylhexyl) amine was dropped for one hour while keeping the temperature at 50°-60° C. and then further aged for one hour at that temperature. Then, one mol of aqueous 30% sulfuric acid solution was used for neutralization, the aqueous layer was separated to remove and the residue was dehydrated under a reduced pressure to obtain 495 g of pale green oily product. The molybdenum content was 14.3% and the yield was 73.7% in view of molybdenum.

EXAMPLE 3

One mol of molybdenum trioxide was dissolved in 540 ml of water under a nitrogen gas stream, to which 0.8 mol of sodium hydroxide was added to form a uniform solution. Then, 2 mol of dibenzyl amine was dropped for one hour while keeping the temperature at 50°-60° C. and then further aged for one hour at that temperature. Then, 0.8 mol of aqueous 30% hydrochloric acid solution was used for neutralization, the aqueous layer was separated to remove and the residue was dehydrated under a reduced pressure to obtain 460 g of pale blue oily product. The molybdenum content was 19.3% and the yield was 92.5% in view of molybdenum.

EXAMPLE 4

One mol of sodium molybdate was dissolved in 540 ml of water under a nitrogen gas stream and then 2 mol of monotridecyl amine was dropped for one hour while keeping the temperature at 50°-60° C. and then further aged for one hour at that temperature. Then, one mol of aqueous 30% sulfuric acid solution was used for neutralization, the aqueous layer was separated to remove and the residue was dehydrated under a reduced pressure to obtain 510 g of pale green oily product. The molybdenum content was 18.1% and the yield was 96.2% in view of molybdenum.

EXAMPLE 5

One mol of sodium molybdate was dissolved in 540 ml of water under a nitrogen gas stream and then 2 mol of dimethyllauryl amine was dropped for one hour while keeping the temperature at 50°-60° C. and then further aged for one hour at that temperature. Then, one mol of aqueous 30% sulfuric acid solution was used for neutralization, the aqueous layer was separated to remove and the residue was dehydrated under a reduced pressure to obtain 525 g of pale blue oily product. The molybdenum content was 13.2% and the yield was 72.2% in view of molybdenum.

EXAMPLE 6

One mol of molybdenum trioxide, one mol of ditridecyl amine and 5 mol of water were reacted at a temperature from 100° to 105° C. for 3 hours under a nitrogen gas stream. After dehydration under a reduced pressure, unreacted molybdenum trioxide was removed by filtration to obtain 505 g of green-brown viscous oily product. The molybdenum content was 15.2% and the yield was 80.0% in view of molybdenum.

EXAMPLE 7

One mol of sodium molybdate was dissolved in 540 ml of water under a nitrogen gas stream, and 0.17 mol of sodium hydroxide was added to carry out reducing reaction at a temperature from 50° to 60° C. for about one hour. Then, 2 mol of ditridecyl amine was dropped for one hour while keeping the temperature at 50°-60° C. and then further aged for one hour at that temperature. Then, one mol of aqueous 30% sulfuric acid solution was used for neutralization, the aqueous layer was separated to remove and the residue was dehydrated under a reduced pressure to obtain 810 g of green oily product. The molybdenum content was 11.0% and the yield was 92.8% in view of molybdenum.

EXAMPLE 8

One mol of sodium molybdate was dissolved in 540 ml of water under a nitrogen gas stream and 0.17 mol of sodium hydrosulfite was added to carry out reducing reaction at a temperature from 50° to 60° C. for about one hour. Then, one mol of di(2-ethylhexyl) amine was dropped while keeping a temperature at 50°-60° C. for one hour and then aged for one hour at that temperature. Then, one mol of aqueous 30% sulfuric acid solution was used for neutralization, the aqueous layer was separated to remove and the residue was dehydrated under a reduced pressure to obtain 475 g of dark green oily product. The molybdenum content was 13.2% and the yield was 65.3% in view of molybdenum.

EXAMPLE 9

One mol of molybdenum trioxide was dispersed in 540 ml of water under a nitrogen gas stream and 0.8 mol of sodium hydroxide was added to form a uniform solution. Then 0.17 mol of sodium hydrosulfite was added to carry out reducing reaction at a temperature from 50° to 60° C. for about one hour. Then, 2 mol of dibenzyl amine was dropped while keeping a temperature at 50°-60° C. for one hour and then aged for one hour at that temperature. Then, 0.8 mol of aqueous 30% hydrochloric acid solution was used for neutralization, the aqueous layer was separated to remove and the residue was dehydrated under a reduced pressure-to obtain 450 g of blue-green oily product. The molybdenum content was 18.8% and the yield was 88.1% in view of molybdenum.

EXAMPLE 10

One mol of sodium molybdate was dissolved in 540 ml of water under a nitrogen gas stream and 0.17 mol of sodium hydrosulfite was added to carry out reducing reaction at a temperature from 50° to 60° C. for about one hour. Then, 2 mol of tridecyl amine was dropped while keeping a temperature at 50°-60° C. for one hour and then aged for one hour at that temperature. Then, one mol of aqueous 30% sulfuric acid solution was used for neutralization, the aqueous layer was separated to remove and the residue was dehydrated under a reduced pressure to obtain 505 g of green oily product. The molybdenum content was 17.8% and the yield was 93.6% in view of molybdenum.

EXAMPLE 11

One mol of sodium molybdate was dissolved in 540 ml of water under a nitrogen gas stream and 0.17 mol of sodium hydrosulfite was added to carry out reducing reaction at a temperature from 50° to 60° C. for about one hour. Then, 2 mol of dimethyllauryl amine was dropped while keeping a temperature at 50°-60° C. for one hour and then aged for one hour at that temperature. Then, 1 mol of aqueous 30% sulfuric acid solution was used for neutralization, the aqueous layer was separated to remove and the residue was dehydrated under a reduced pressure to obtain 505 g of green-brown oily product. The molybdenum content was 12.5% and the yield was 65.8% in view of molybdenum.

EXAMPLE 12

The compounds obtained in Examples 1-11 and commercial Mo-DTP and Mo-DTC as the comparison were dissolved each by 0.1 wt % converted as the molybdenum content to commercial engine oils (SD class: 10W-30, sulfur content: 0.24 wt %) and heated at 100° C. for 3 hours while immersing copper plates in the oil to test the corrosion behavior to the copper plates (according to ASTM D-130). The results are shown in Table 1.

TABLE 1

| Compound used | Copper plate discoloration |
|---|---|
| Compound obtained in Example 1 | 1a |
| Compound obtained in Example 2 | 1a |
| Compound obtained in Example 3 | 1a |
| Compound obtained in Example 4 | 1a |
| Compound obtained in Example 5 | 1a |
| Compound obtained in Example 6 | 1a |
| Compound obtained in Example 7 | 1a |
| Compound obtained in Example 8 | 1a |
| Compound obtained in Example 9 | 1a |

TABLE 1-continued

| Compound used | Copper plate discoloration |
|---|---|
| Compound obtained in Example 10 | 1a |
| Compound obtained in Example 11 | 1a |
| Commercial Mo—DTP | 2a |
| Commercial Mo—DTC | 1b |

EXAMPLE 13

The compounds obtained in Examples 1-11 and comparative products were compared for the anti-oxidation effect and metal corrosion behavior by the oil degradation test due to TOST method.

Test Method

Test was according to JIS-K-2514: Turbine Oil Oxidation Stabilization Test. 90° C.×480 hours, Catalyst: steel wire and copper wire, Base oil: commercial gear oil (ISO viscosity: 220, sulfur content 1.31 wt %), concentration: 0.2 wt % as molybdenum.

The results are shown in Table 2.

TABLE 2

| | Compound used | Increased acid value (mgKOH/g) | Corrosion for steel wire | Corrosion for copper wire |
|---|---|---|---|---|
| This invention | Compound obtained in Example 1 | 0.09 | no corrosion | no corrosion |
| | Compound obtained in Example 2 | 0.11 | no corrosion | no corrosion |
| | Compound obtained in Example 3 | 0.12 | no corrosion | no corrosion |
| | Compound obtained in Example 4 | 0.16 | no corrosion | slight discoloration |
| | Compound obtained in Example 5 | 0.14 | no corrosion | no corrosion |
| | Compound obtained in Example 6 | 0.09 | no corrosion | no corrosion |
| | Compound obtained in Example 7 | 0.11 | no corrosion | no corrosion |
| | Compound obtained in Example 8 | 0.15 | no corrosion | slight discoloration |
| | Compound obtained in Example 9 | 0.12 | no corrosion | no corrosion |
| | Compound obtained in Example 10 | 0.15 | no corrosion | slight discoloration |
| | Compound obtained in Example 11 | 0.15 | no corrosion | no corrosion |
| Comparative products | No addition | 0.29 | no corrosion | no corrosion |
| | Commercial Mo—DTP | 0.20 | remarkable corrosion | remarkable corrosion |
| | Commercial Mo—DTC | 0.18 | corrosion | corrosion |

EXAMPLE 14

Compositions comprising a blend of compounds obtained in Examples 1-11 and various kinds of sulfur containing compounds were dissolved each by 0.06 wt % calculated as the molybdenum content into 150 neutral oils and the antiwear effect was measured by a Shell 4-ball tester (indicated by the wear scar diameter after 30 minutes at 1800 rpm at an oil temperature of 80° C., under a load of 40 kg). The frictional coefficient was measured by a pendulum type oil tester (average value for 50 times at an oil temperature of 80° C., under a load of 600 g).

The results are shown in Table 3.

TABLE 3

| | Composition used | | | Wear scar diameter (mm) | Frictional coefficient |
|---|---|---|---|---|---|
| | Compound used | Sulfur-containing compound | Note-1 | | |
| This invention | Compound obtained in Example 1 | Disulfide compound | Note-2 | 0.33 | 0.086 |
| | Compound obtained in Example 2 | Disulfide compound | | 0.35 | 0.072 |
| | Compound obtained in Example 3 | Disulfide compound | | 0.33 | 0.076 |
| | Compound obtained in Example 4 | Disulfide compound | | 0.32 | 0.092 |
| | Compound obtained in Example 5 | Disulfide compound | | 0.39 | 0.073 |
| | Compound obtained in Example 6 | Disulfide compound | | 0.35 | 0.77 |
| | Compound obtained in Example 1 | ZDTP | Note-3 | 0.32 | 0.071 |
| | Compound obtained in Example 2 | ZDTP | | 0.34 | 0.070 |

TABLE 3-continued

| | Composition used | | | Wear scar diameter (mm) | Frictional coefficient |
|---|---|---|---|---|---|
| | Compound used | Sulfur-containing compound | Note-1 | | |
| | Compound obtained in Example 1 | Mo—DTP | Note-4 | 0.32 | 0.065 |
| | Compound obtained in Example 2 | Mo—DTP | | 0.33 | 0.068 |
| | Compound obtained in Example 1 | Mo—DTC | Note-5 | 0.38 | 0.088 |
| | Compound obtained in Example 2 | Mo—DTC | | 0.39 | 0.092 |
| | Compound obtained in Example 1 | Dibenzyl disulfide | | 0.42 | 0.101 |
| | Compound obtained in Example 2 | Dibenzyl disulfide | | 0.43 | 0.110 |
| | Compound obtained in Example 1 | Zinc dioctyl dicarbamate | | 0.44 | 0.112 |
| Comparative product | Compound obtained in Example 1 | none | | 0.65 | 0.162 |
| | Compound obtained in Example 2 | none | | 0.72 | 0.154 |
| | Compound obtained in Example 5 | none | | 0.66 | 0.182 |
| This invention | Compound obtained in Example 7 | Disulfide compound | Note-2 | 0.32 | 0.085 |
| | Compound obtained in Example 8 | Disulfide compound | | 0.34 | 0.069 |
| | Compound obtained in Example 9 | Disulfide compound | | 0.33 | 0.072 |
| | Compound obtained in Example 10 | Disulfide compound | | 0.36 | 0.082 |
| | Compound obtained in Example 11 | Disulfide compound | | 0.35 | 0.088 |
| | Compound obtained in Example 7 | ZDTP | Note-3 | 0.33 | 0.070 |
| | Compound obtained in Example 8 | ZDTP | | 0.33 | 0.065 |
| | Compound obtained in Example 7 | Mo—DTP | Note-4 | 0.32 | 0.066 |
| | Compound obtained in Example 8 | Mo—DTP | | 0.34 | 0.070 |
| | Compound obatined in Example 7 | Mo—DTC | Note-5 | 0.34 | 0.092 |
| | Compound obtained in Example 8 | Mo—DTC | | 0.35 | 0.102 |
| | Compound obtained in Example 7 | Dibenzyl disulfide | | 0.38 | 0.114 |
| | Compound obtained in Example 8 | Dibenzyl disulfide | | 0.42 | 0.122 |
| | Compound obtained in Example 7 | Zinc octyl carbamate | | 0.40 | 0.115 |
| | Compound obtained in Example 8 | Zinc octyl carbamate | | 0.44 | 0.142 |
| Comparative product | Compound obtained in Example 7 | none | | 0.68 | 0.174 |
| | Compound obtained in Example 8 | none | | 0.74 | 0.202 |
| | ZDTP (Zn 1000 ppm) | | | 0.78 | 0.130 |
| | Mo—DTP | | | 0.54 | 0.122 |
| | Mo—DTC | | | 0.72 | 0.192 |

Note 1: 600 ppm as sulfur
Note 2: tetraoctylperoxyphosphate
Note 3: R = 2-ethylhexyl
Note 4: R = 2-ethylhexyl
Note 5: R = 2-ethylhexyl

EXAMPLE 15

The compounds obtained in the respective Examples and Comparative Examples were dissolved in 150 neutral oils and were examined for the friction reducing effect under reciprocating sliding conditions (oil temperature: 120° C., load: 2.2 kgf, 12.2 kgf, 22.2 kgf, number of vibrations: 500 rpm, reciprocating stroke: 2.5 mm, concentration: 0.04 wt % as Mo, sulfur compound: 0.06 wt % as S, test piece material: SUJ-2, shape of the test piece spherical at the upper ¾ inch, flat plate at the lower portion).

The results are shown in Table 4.

EXAMPLE 16

CRC L-38 bearing corrosion test

The compounds obtained in the respective Examples and Comparative Compounds were added each by 0.06 wt % to commercial engine oils containing sulfur compounds to prepare test lubricants.

Respective fine pieces of copper and lead were immersed in test lubricants and the lubricants were heated at 95° C. for 20 hours. The copper pieces were weighed and then the lubricants were washed with potassium cyanide solution for removing the precipitates of cop-

TABLE 4

| | Compound used | sulfur-containing compound | Frictional coefficient (after 15 min) | | |
|---|---|---|---|---|---|
| | | | 2.2 kgf | 12.2 kgf | 22.2 kgf |
| This invention | Compound obtained in Example 1 | disulfide compound | 0.036 | 0.058 | 0.083 |
| | Compound obtained in Example 2 | disulfide compound | 0.038 | 0.063 | 0.093 |
| | Compound obtained in Example 1 | ZDTP | 0.040 | 0.071 | 0.094 |
| | Compound obtained in Example 1 | Mo—DTP | 0.035 | 0.048 | 0.059 |
| | Compound obtained in Example 1 | Mo—DTC | 0.042 | 0.062 | 0.102 |
| | Compound obtained in Example 1 | Dibenzyl disulfide | 0.054 | 0.082 | 0.114 |
| | Compound obtained in Example 7 | Disulfide compound | 0.040 | 0.052 | 0.082 |
| | Compound obtained in Example 8 | Disulfide compound | 0.043 | 0.062 | 0.092 |
| | Compound obtained in Example 7 | ZDTP | 0.039 | 0.048 | 0.072 |
| | Compound obtained in Example 7 | Mo—DTP | 0.037 | 0.042 | 0.063 |
| | Compound obtained in Example 7 | Mo—ETC | 0.062 | 0.088 | 0.103 |
| | Compound obtained in Example 7 | Dibenzyl disulfide | 0.093 | 0.121 | 0.128 |
| Comparative product | Compound obtained in Example 1 | none | 0.092 | 0.105 | 0.168 |
| | Compound obtained in Example 2 | none | 0.159 | 0.198 | 0.216 |
| | Compound obtained in Example 7 | none | 0.165 | 0.182 | 0.203 |
| | Compound obtained in Example 8 | | 0.172 | 0.193 | 0.211 |
| | ZDTP (Zn 1000 ppm) | | 0.163 | 0.204 | 0.208 |
| | Mo—DTP | | 0.092 | 0.102 | 0.113 |
| | Mo—DTC | | 0.122 | 0.163 | 0.168 |

per compound. Then, the pieces were weighed again to determine the reduction of the weight in the two kind of fine pieces as the measure for the degree of corrosion caused in the oils.

| | | CRC-L-38 | |
|---|---|---|---|
| | | Cu (mg) | Pb (mg) |
| This invention | Compound obtained in Example 1 | 16.1 | 2.9 |
| | Compound obtained in Example 2 | 15.1 | 3.1 |
| | Compound obtained in Example 3 | 16.1 | 2.4 |
| | Compound obtained in Example 6 | 14.1 | 2.1 |
| | Compound obtained in Example 7 | 16.2 | 3.5 |
| | Compound obtained in Example 8 | 15.0 | 2.8 |
| | Compound obtained in Example 9 | 14.3 | 3.4 |
| Comparative Product | Commercial Mo—DTP | 37 | 5.0 |
| | Commercial Mo—DTC | 35 | 4.9 |
| | Standard oil (10W-40, SE grade) | 23 | 4.6 |

EXAMPLE 17

Bronze Corrosion Test

The organic molybdenum compound was added to commercial oils (10W-30, SE grade) to prepare test oils, and bronze specimens were immersed in the test oils at 250° F. for 24 hours to observe the discoloration of the test piece.

| | (ASTM D-130) | |
|---|---|---|
| Material | Bronze | C53400 (Cu—4Sn—1Pb—0.3P) |
| 1. Commercial oil (SE, 10W-30) | | 1B |
| 2. | + 2% compound in Example 1 (Mo 0.09 wt %) | 1B |
| 3. | + 4% (Mo 0.18 wt %) | 1B |
| 4. | + commercial 2% Mo—DTP | 4A |
| 5. | + commercial 4% Mo—DTP | 4C |
| 6. | + commercial 2% Mo—DTC | 3b |
| 7. | + commercial 4% Mo—DTC | 4B |

EXAMPLE 18

Motor Ring Torque Test

The torque reduction test in the engine with the compounds obtained in Examples were carried out as described below:

| | |
|---|---|
| Engine | 1800 cc OHC |
| Speed | 600-3000 rpm |
| Oil temperature | 90° C. |

| | Torque reduction rate |
|---|---|
| (1) Oils containing the compound obtained in Example 1 | 9% |
| (2) Comparative oils: commercial oils containing commercial Mo—DTP | 8% |
| (3) Standard oils Commercial oils 10W-30 SE (containing ZnDTP 0.8 wt %) | standard |

Note:
Oils (1), (2) are prepared by adding the standard oil and molybdenum compound.

According to this invention, lubricant additives having excellent anti-oxidation and anti-wear effects and friction reducing effect over those of conventionally used ZDTP or molybdenum-containing lubricant additives and, particularly, excellent in view of the metal corrosion is provided by the combined use of a novel molybdenum-amine complex and a sulfur-containing compound. Since the additives ar excellent in of the the metal corrosion behavior, they can serve also as excellent additives to the pitting wear for various kinds of engine parts resulted in relation with the metal corrosions.

What is claimed is:

1. A lubricant composition comprising a blend of a sulfur-containing compound and an oil-soluble molybdenum compound wherein the ratio of sulfur atoms to molybdenum atoms is higher than 0.5, said oil-soluble molybdenum compound having been obtained by reacting (1) at least one hexavalent molybdenum compound selected from the group consisting of molybdenum trioxide, molybdic acid and alkali salts of molybdic acid, with (2) a secondary amino compound having the formula

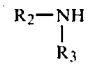

wherein $R_2$ and $R_3$, which are the same or different, are hydrocarbon groups having 1 to 30 carbon atoms.

2. A lubricant composition comprising a blend of a sulfur-containing compound and an oil-soluble molybdenum compound wherein the ratio of sulfur atoms to molybdenum atoms is higher than 0.5, said oil-soluble molybdenum compound having been obtained by reducing at least one hexavalent molybdenum compound selected from the group consisting of molybdenum trioxide, molybdic acid and alkali salts of molybdic acid, with a reducing agent capable of reducing the molybdenum valency to five or four, whereby to obtain a first reaction product and then reacting said first reaction product with an amino compound having the formula

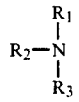

wherein $R_1$, $R_2$ and $R_3$, which are the same or different, are hydrogen or hydrocarbon groups having 1 to 30 carbon atoms, with the proviso that at least one of $R_1$, $R_2$ and $R_3$ is a hydrocarbon group.

3. A lubricant composition as defined in claim 2, wherein the amino compound is a secondary amine having a hydrocarbon group of 6 to 24 carbon atoms.

4. A lubricant composition as defined in claim 1 or claim 2, wherein the sulfur-containing compound is a compound represented by the general formula:

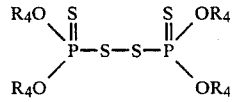

where respective $R_4$, which may be identical with or different from each other, represent individually hydrocarbon groups of 3 to 24 carbon atoms.

5. A lubricant composition as defined in claim 1 or claim 2 wherein the sulfur-containing compound is a compound represented by the general formula:

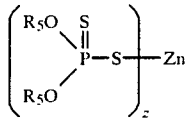

where respective $R_5$, which may be identical with or different from each other, represent individually hydrocarbon groups of 3 to 24 carbon atoms.

6. A lubricant composition as defined in claim 1 or claim 2 wherein the sulfur-containing compound is a compound represented by the general formula:

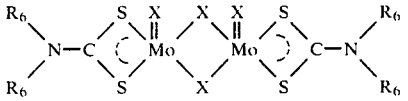

where respective $R_6$, which may be identical with or different from each other, represent individually hydrocarbon groups of 7 to 24 carbon atoms and X is S or O.

7. A lubricant composition as defined in claim 1 or claim 2 wherein the sulfur-containing compound is a compound represented by the general formula:

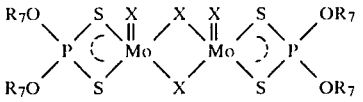

where respective $R_7$, which may be identical with or different from each other represent individually hydrocarbon groups of 3 to 24 carbon atoms and X is S or O.

8. A lubricant composition as claimed in claim 1 or claim 2 in which the ratio of molybdenum atom to amine in said oil-soluble molybdenum compound is from 1:1 to 1:4.

9. A lubricant composition as claimed in claim 1 or claim 2 wherein said amino compound is selected from the group consisting of ditridecyl amine, di(2-ethylhexyl) amine and dibenzyl amine.

10. A lubricant composition as claimed in claim 2 wherein said amino compound is selected from the group consisting of ditridecyl amine, di(2-ethylhexyl) amine, dibenzyl amine, tridecyl amine and dimethyllauryl amine.

11. A lubricant composition as claimed in claim 1 or claim 2 in which the reaction is carried out in water, an acid is added to neutralize the reaction mixture and then the water is removed and said oil-soluble molybdenum compound is recovered.

* * * * *